United States Patent [19]

Poeppel

[11] 4,168,673

[45] Sep. 25, 1979

[54] FLOATING ISLAND FOR EXTRACTING OR PROCESSING GAS

[75] Inventor: Fritz O. Poeppel, Wunstorf, Fed. Rep. of Germany

[73] Assignee: Preussag Aktiengessellschaft, Fed. Rep. of Germany

[21] Appl. No.: 918,083

[22] Filed: Jun. 22, 1978

Related U.S. Application Data

[63] Continuation of Ser. No. 761,985, Jan. 24, 1977, abandoned.

[30] Foreign Application Priority Data

Jan. 26, 1976 [DE] Fed. Rep. of Germany ..... 2602747

[51] Int. Cl.[2] ..... B63B 35/44

[52] U.S. Cl. ..... 114/265

[58] Field of Search ..... 114/256, 264–265, 114/293, 294, 74 A, 230; 9/8 P; 61/86, 98, 100, 101; 405/227, 203

[56] References Cited

U.S. PATENT DOCUMENTS

| | | | |
|---|---|---|---|
| 2,939,291 | 6/1960 | Schurman et al. | 114/265 |
| 3,077,615 | 2/1963 | Schultz | 9/8 P |
| 3,161,492 | 12/1964 | Keith et al. | 405/203 |
| 3,161,492 | 12/1964 | Keith et al. | 61/86 |
| 3,289,624 | 12/1966 | Pratt | 114/74 A |
| 3,295,489 | 1/1967 | Bossa | 114/294 |
| 3,327,780 | 6/1967 | Knapp et al. | 14/265 |
| 3,355,899 | 12/1967 | Koonc et al. | 114/265 |
| 3,490,406 | 1/1970 | O'Reilly et al. | 114/265 |
| 3,507,238 | 4/1970 | Chow | 114/265 |
| 3,646,771 | 3/1972 | Greene | 114/328 |
| 3,712,068 | 1/1973 | Liautaud | 405/203 |
| 3,765,353 | 10/1973 | Rosenberg | 114/265 |
| 3,765,353 | 10/1973 | Rosenberg | 114/265 |
| 3,771,481 | 11/1973 | Goren et al. | 114/265 |
| 3,778,854 | 12/1973 | Chow | 9/8 P |
| 3,988,995 | 11/1976 | Finsterwalder | 114/74 A |
| 4,007,599 | 2/1977 | Brown | 9/8 P |

*Primary Examiner*—Jesus D. Sotelo

*Attorney, Agent, or Firm*—Allegretti, Newitt, Witcoff & McAndrews

[57] ABSTRACT

A floating island for the extraction of gas from the sea having a plurality of buoyancy units positioned on a base plate with columns extending upward therefrom, a height approximately the wave height expected. A platform containing gas liquefaction apparatus is positioned on the top of the columns. The buoyancy units are selected so that when the island is free floating, the columns project more than half way from the water.

7 Claims, 3 Drawing Figures

FLOATING ISLAND FOR EXTRACTING OR PROCESSING GAS

This is a continuation of application Ser. No. 761,985 filed Jan. 24, 1977, now abandoned.

BACKGROUND OF THE INVENTION

The invention relates to a floating island for extracting or processing gas.

The publication "Floating Offshore LNG Liquefaction Facility—A Cost Effective Alternative", author M. C. Terry, of the Global Marine Development Inc., published on the occasion of the Seventh Annual Offshore Technology Conference in Houston, Texas on 5th–8th May 1975, describes gas extraction in coastal regions wherein the gas is transported to the shore by way of a pipeline laid on the bottom of the sea. The transported gas is liquefied on shore in a stationary installation, and the liquefied gas is then shipped in tankers. The investment involved in transporting the non-liquefied gas to shore is considerable. The pipeline and the liquefaction installation are fixed in one place. As a result, such an installation can be justified only when large deposits of natural gas are available, preferably near the coast. This prior art installation is not suitable for using low yield natural gas deposits.

The publication authored by Terry also describes a liquefaction facility installed on a ship which, for safety reasons is not anchored immediately over the gas field but in the immediate vicinity thereof. The gas passes by way of a sea bed pipeline to the ship where it is liquefied. The ship, however, has limited storage capacity. As a result, the intermediate storage tanks on the ship have to be periodically emptied by relatively small tankers. An important disadvantage of this liquefaction proposal is that the ship moves in response to the wave motion. Existing standards require a relatively steady liquefaction plant. As a consequence, this proposal seem possible only if great disadvantages are accepted. In addition, because of movement of the ship, there are difficulties in the transfer of the liquefied gas to a tanker.

SUMMARY OF THE INVENTION

The invention has, as its object, to provide a floating island for extracting or processing gas which allows exploitation of relatively small gas deposits with little financial investment, permits liquefaction and/or further processing of the gas, and provides adequate interim storage facilities.

The object of the invention is achieved in a floating island having a plurality of submerged buoyancy units positioned in a single plane on a base plate, and from which columns extend upward above the water surface in accordance with the wave height expected. These columns carry on their upper ends a platform on which is located an apparatus for the liquefaction of gas. The buoyancy of the buoyancy units is selected so that the island when it is freely floating, the columns project upward more than half way. Preferably, the buoyancy units are also partly above the water surface. In addition, there is positioned on the base plate, ties or tension elements whereby the island can be submerged to about half the height of the columns by means of anchors positioned on the sea bed.

The solution to the prior art problems provided by the present invention has the advantage of providing a floating island with extremely good floating stability.

As a result, it is possible to position a gas liquefaction plant on the platform of the floating island. The floating stability is so great that even in bad weather and relatively high seas, it is not necessary to interrupt gas liquefaction operations. Wave influence on the island is greatly reduced by submerging the buoyancy units completely, and as the waves pass, the columns projecting through the surface of the water have only a slight buoyancy modification, which in turn is taken up by the tensioned anchoring means.

The periodical "Offshore", November 1973, page 100, discloses anchoring floating bodies to the bottom of the sea under tension. The floating bodies, however, project through the water surface with their entire cross-section, so that the passage of waves has considerable influence on the body and the body adapts little to different loads. The island, which is referred to as a "traction leg platform", is only intended and suited for drilling purposes.

The article "Cable Stayed Submerged Buoyant Drilling/Production Structures", published as "Paper 5" at the Technology Offshore (North Sea) Conference on 30/31st July 1974, discloses a traction leg platform intended for extracting and processing oil, and has several tanks which are intended for buoyancy and storage purposes, and together form an intregal unit held in a submerged state by obliquely tensioned cables, and from which columns extend above the water surface to a platform.

The use of tanks for filling both with ballast water and also with oil presents no difficulties. Such principals of buoyancy equalization cannot be used in the case of rigs for extracting and processing gas since the storage chambers for liquefied gas cannot be filled with sea water. In an embodiment disclosed in this North Sea Conference article, an additional buoyancy chamber is, in fact provided. This is, however, indicated only schematically, so that information for practical construction cannot be determined therefrom. It can be ascertained that the buoyancy chamber is positioned above the tanks. If the buoyancy chamber were filled with water as indicated in the article to compensate for the buoyancy, the buoyancy stability would suffer amongst other things. In addition, as discussed earlier, such a chamber could not be used to store liquefied gas.

A further disadvantage of this proposal is that the considerable forces resulting from excess buoyancy are taken up solely by obliquely tensioned cables. As a result, the forces on the cables are greater than the buoyancy forces, so that the outlay for the traction legs is increased. In addition, the increased number of cables or the larger cross-section of the tension cables results in the influence of water movements being increased e.g. ocean currents or waves. As a result, the floating stability of the complete island is reduced. Therefore, there would be considerable difficulties in the processing of liquefied gas from this structure where extremely steady or stable floating is necessary.

In the present invention, the buoyancy units and preferably the columns and the base plate are made from concrete. Therefore, they are very resistant to the action of sea water. The concrete buoyancy units can also be used, in an advantageous manner, to store liquefied gas which, for this purpose, have insulated internal walls, such as PVC foam insulation.

According to a further feature of the invention, the base plate comprises ballast chambers for sea water. These chambers are sized so that the buoyancy of the buoyancy units which are used for storage of liquefied gas is reduced in the desired manner so that only the columns project through the water surface in the region where there is wave motion. Therefore, it is not necessary, as it is with known floating islands for the extraction of petroleum, to fill the tanks which have been used to store petroleum with sea water.

According to a further feature of the invention, the tension elements are taken from the base plate preferably through the buoyancy units and the columns above the water line. In this way the depth to which the island is submerged is adjustable.

The tension elements may all be of the same construction, but it is convenient to construct at least one of them as a centrally arranged tube anchored securely in the sea bottom thereby providing access through this tube from the platform to the sea bottom. This tube can accept a substantial part of the tensile forces.

According to a still further feature of the invention, a transfer apparatus for transferring liquefied gas to a tanker is provided on the platform. This transfer apparatus enjoys the advantage that the island of the present invention sits in the water in a safe and steady manner.

According to the present invention, the island has substantially no relative movement with respect to the sea bottom, thus affording advantages relative to the connection between the gas source and the island. In addition, there is less risk of collision between the island and a moored tanker. This risk occurs particularly when the tidal current changes. In order to make it possible to follow or adjust for the direction of the tide or the wind, the transfer apparatus and the mooring line for a tanker are positioned on a carriage capable of moving around about the circular platform. In this way, the transfer apparatus and mooring line can always follow the direction of the current. In addition, the moored tanker can keep its distance by running its engines in reverse.

DETAILED DESCRIPTION OF THE INVENTION

The invention will be discussed in detail with reference to the attached drawings.

Figure 1:
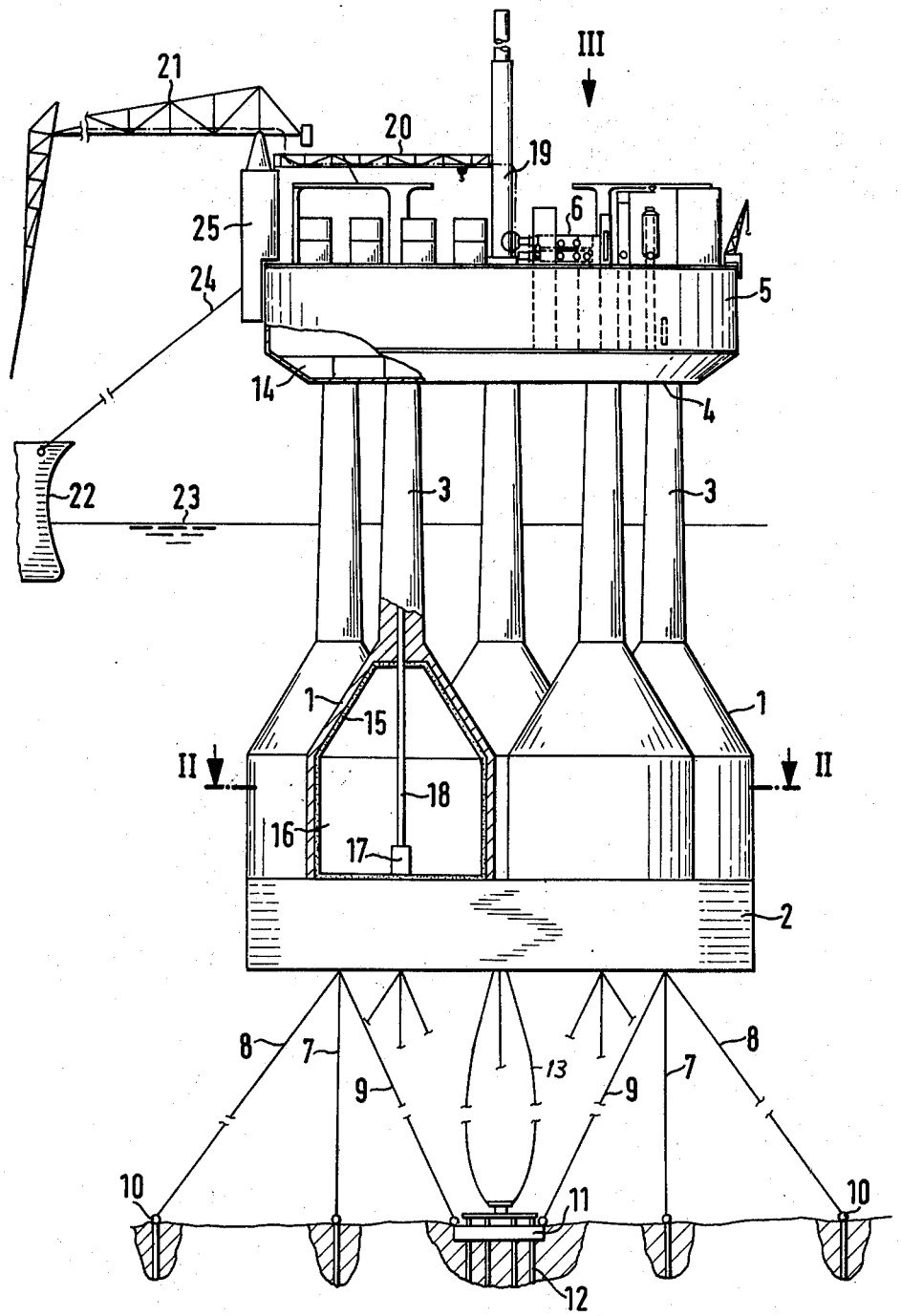
FIG. 1 illustrates a side partial sectional view of one embodiment of an island according to the invention.

The island shown in side view in FIG. 1 comprises five buoyancy units 1 which are positioned on a base plate 2 and from which columns 3 extend upward and supporting on their upper ends 4, a platform 5. There is positioned on platform 5 an apparatus 6 for liquefaction of gas including the necessary energy supply and operating installations.

Positioned on the outer edge of the base plate 2 are vertical tension elements 7 and obliquely downwardly extending tension elements 8 and 9 which are secured to piles 10 secured to the sea bed. The vertical tension elements 7 consist of steel chains or cables, while the oblique tension elements 8 and 9 consist of hawsers having a specific gravity of about 1 and are preferably manufactured from a plastic material. The oblique tension elements 9 are secured to a base plate 11 held in position by stay tube barrel members 12.

High pressure gas conduits 13 extend from the base plate 11 to the base plate 2, from which the gas passes by way of conduits, not shown, to the liquefaction installation 6 on platform 5.

The platform includes in the bottom region thereof a plurality of closed chambers 14 to ensure that the platform is capable of floating even if the bottom is damaged. Upper ends 4 of the columns 3, in emergency also provides flotation.

The buoyancy units 1 and the base plate 2 and the columns 3 are made of concrete. One of the buoyancy units 1 is shown in section in FIG. 1. It is hollow and has walls of prestressed concrete which are insulated internally by an insulating layer 15 of PVC foam. The chambers 16 thus formed in the buoyancy units 1 can thus be used for the storage of liquefied gas, which at atmospheric pressure, has a temperature of −162° C. The chambers 16 are provided with a pump 17 and a conduit 18 leading upwards through the columns 3 to empty chambers 16. The conduit 18 leads by way of a column 19 and a beam 20 to a transfer apparatus 21 so that the liquefied gas can be unloaded onto a tanker 22 floating on the surface 23 of the water.

The mooring line 24 is positioned on a carriage 25 which also supports the transfer apparatus 21 and which can travel around circular platform 5.

Figure 2:
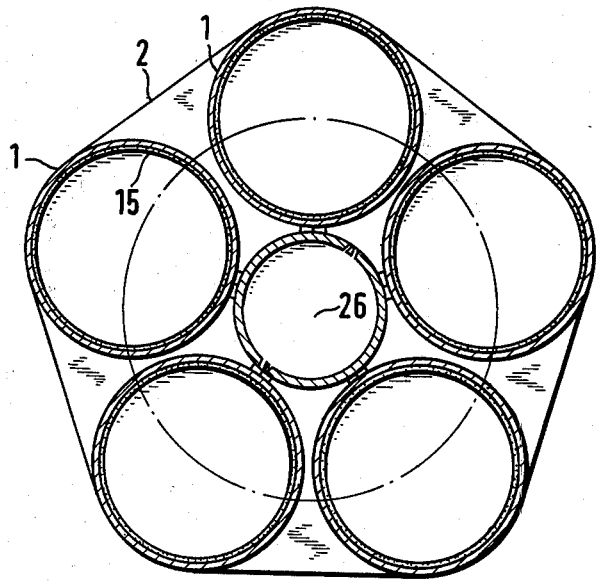
FIG. 2 is a section view taken on section line II—II of FIG. 1.

FIG. 2 (section on II—II through FIG. 1) clearly illustrates that the buoyancy units 1 are arranged in a regular pentagon on the platform 5. A through passage 26 is centrally located on platform 5.

Figure 3:
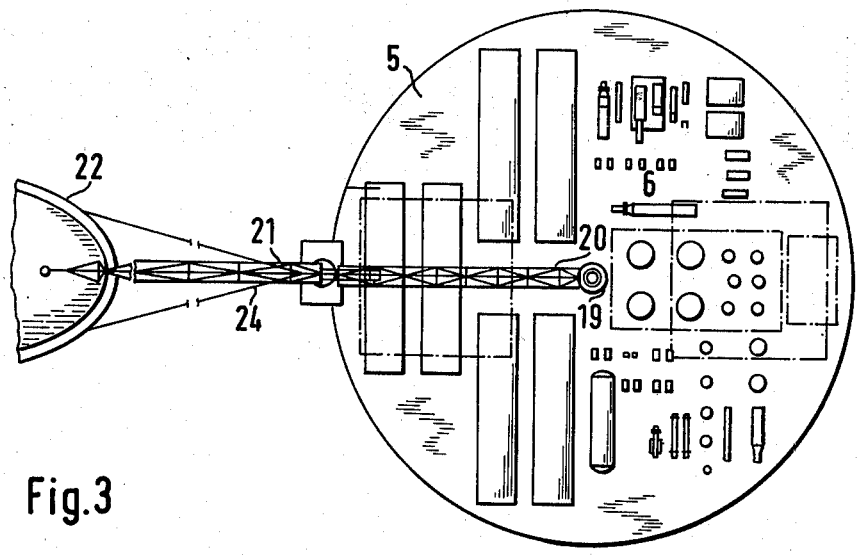
FIG. 3 is a plan view in the direction of arrow III in FIG. 1.

FIG. 3 taken in the direction of arrow III in FIG. 1, illustrates the round shape of the platform 5, which makes it possible for the carriage 25 to travel round the platform 5, in order to align the location of the carriage, the mooring line 24 and transfer apparatus 21 towards the tanker 22 which is positioned in line with the water current.

The vertical tension elements 7 accept the greatest part of the tensile forces which hold the island in the semi-submerged state such that the columns 3 are submerged substantially half way. The length of the columns 3 corresponds substantially to the greatest wave amplitude value expected. The buoyancy of the buoyancy units 1 is so great that under all operating conditions the tension elements 7, 8 and 9 remain tensioned. In this way, not only is the island held securely against lateral shifting, but the island is also secured against tilting, leaning and rolling movements in addition to the inherent stability of the island itself. The steady floating ability of the island is so great that the gas liquefaction apparatus 6 can operate even in a relatively heavy sea and in storms.

Since liquid gas can be loaded direct from the island onto a tanker, there is no need to provide additional pipelines, particularly pipelines on the sea bed. In addition, no intermediate storage tanks are needed. Therefore, the island according to the invention can be moved to another location after one natural gas field with relatively low yield is exhausted, without any difficulty, and anchored again on the new site.

I claim as my invention:

1. A readily movable and securable floating island for a gas extraction and liquefaction system of the type providing a liquefied gas product comprising, in combination:

a submerged base plate having at least one ballast chamber wherein sea water is storable;

a tension-legged mooring system for releasably and adjustably securing said submerged base plate to the sea bed whereby said floating island is readily moved between production sites and readily secured for operation;

a plurality of substantially hollow buoyancy chambers secured to said submerged base plate and defining submerged storage means for storing said liquefied gas product, said submerged base plate and said substantially hollow buoyancy chambers providing a buoyant force to counteract the weight of said gas extraction and liquefaction system and to maintain said tension-legged mooring system in a substantially tensioned state;

said submerged base plate, said tension legged mooring system and said substantially hollow buoyancy chambers cooperatively defining stabilizer means for substantially avoiding movement of said floating island during operation of said gas extraction and liquefaction system;

a series of columns extending upwardly from said substantially hollow buoyancy chambers, respectively, said tension-legged mooring system being adjusted to maintain said floating island in a position wherein said columns project substantially half way above the water surface; and a platform for supporting said gas extraction and liquefaction system, said platform being secured to and supported by said columns.

2. A floating island according to claim 1 wherein said base plate has an outer edge, said tension-legged mooring system further including a plurality of tension elements attached between said outer edges and the sea bed, whereby the stability of said readily movable and securable floating island is enhanced.

3. A floating island according to claim 2 wherein said tension elements are secured between said base plate and the sea bed in a substantially vertical orientation and in an oblique orientation, whereby said readily movable and securable floating island is held in a predetermined horizontal position.

4. A floating island according to claim 3 wherein said obliquely oriented tension elements are manufactured from a material having a specific gravity of about 1.

5. A floating island according to claim 1 wherein said tension-legged mooring system includes a centrally positioned tube defining access means for reaching the sea bed from said readily movable and securable floating island.

6. A floating island according to claim 1 which includes a transfer means on said platform for transferring said liquefied gas product from said buoyancy chamber to a vessel adjacent said readily movable and securable floating island.

7. A floating island according to claim 1 wherein said buoyancy chambers are lined with heat insulating material, whereby storage of said liquefied gas product is facilitated.

* * * * *